United States Patent [19]

Sentinella

[11] 4,013,255

[45] Mar. 22, 1977

[54] EXTINGUISHER MOUNTINGS

[76] Inventor: Victor Edward Sentinella, Caterham, England

[22] Filed: Sept. 5, 1975

[21] Appl. No.: 610,766

Related U.S. Application Data

[62] Division of Ser. No. 460,174, April 11, 1974, Pat. No. 3,921,950.

[30] Foreign Application Priority Data

Apr. 12, 1973 United Kingdom ..... 17774/73
Oct. 18, 1974 United Kingdom ..... 11384/74

[52] U.S. Cl. ..... 248/313; 211/71
[51] Int. Cl.[2] ..... A62C 39/00
[58] Field of Search ..... 248/316 R, 316 B, 309, 248/313, 311, 154; 211/89, 71, 88, 8

[56] References Cited

UNITED STATES PATENTS

| | | | |
|---|---|---|---|
| 2,291,984 | 8/1942 | Ponselle | 248/154 |
| 2,650,786 | 9/1953 | Platt | 248/154 X |
| 2,698,597 | 1/1955 | Buck | 248/313 X |
| 3,041,030 | 6/1962 | Heimrich | 248/DIG. 7 |
| 3,737,133 | 6/1973 | Boecker | 248/313 |
| 3,823,907 | 7/1974 | Ziaylek | 248/313 |

*Primary Examiner*—J. Franklin Foss
*Attorney, Agent, or Firm*—Brisbois & Kruger

[57] ABSTRACT

A fire extinguisher mounting is disclosed in which the extinguisher is retained in a mounting frame by a pressure plate assembly actuated by an over-center mechanism. The over-center mechanism holds the extinguisher secure against vibration and the like and comprises a toggle arrangement actuated by a quick-release handle. The retaining forces act on the top and bottom of the extinguisher.

10 Claims, 3 Drawing Figures

EXTINGUISHER MOUNTINGS

This application is a division of application serial No. 460,174 filed Apr. 11, 1974 now U.S. Pat. No. 3,921,950.

This invention relates to mountings for fire extinguishers.

It will be readily understood that a mounting for a fire extinguisher should be such that the extinguisher can be rapidly and easily removed from the mounting in an emergency and brought into action. On the other hand, where an extinguisher is provided on a road vehicle, for example, the mounting must be sufficiently secure to prevent the extinguisher being displaced due to shock or vibration as the vehicle is in transit.

It is an object of the invention to provide an improved mounting for a fire extinguisher.

The present invention provides a mounting for a fire extinguisher, the mounting comprising:

a spine member adapted for fixing in an upright position on a support, first force applying means mounted at one end of said spine member and projecting transversely therefrom, second force applying means mounted at the other end of said spine member and projecting transversely therefrom to co-operate with said first force applying means, said second force applying means including an over-centre linkage pivotally connected to said other end of said spine member, and manual operating means connected to said second force applying means and arranged to move said second force applying means from a position away from said first force applying means to a position towards said first force applying means in which position said over-centre linkage is in its over-centre position and said first and second force applying means apply retaining forces to the top and bottom of the extinguisher.

Figure 1:
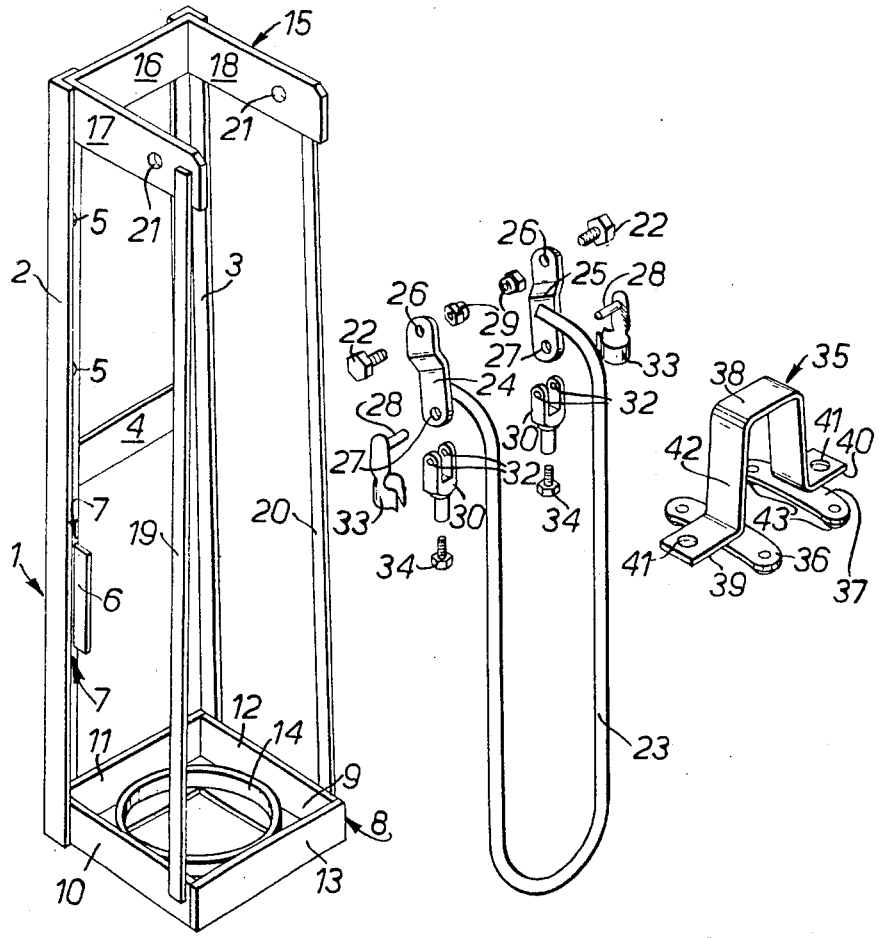
Figure 3:
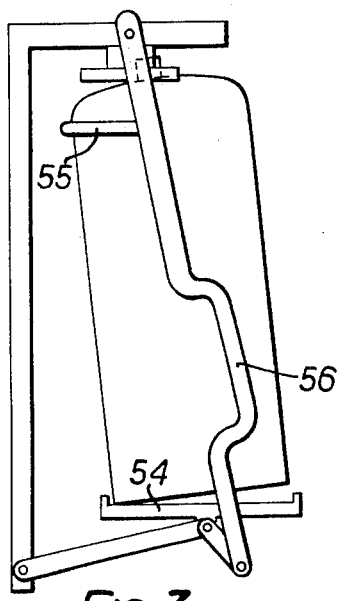
Figure 2:
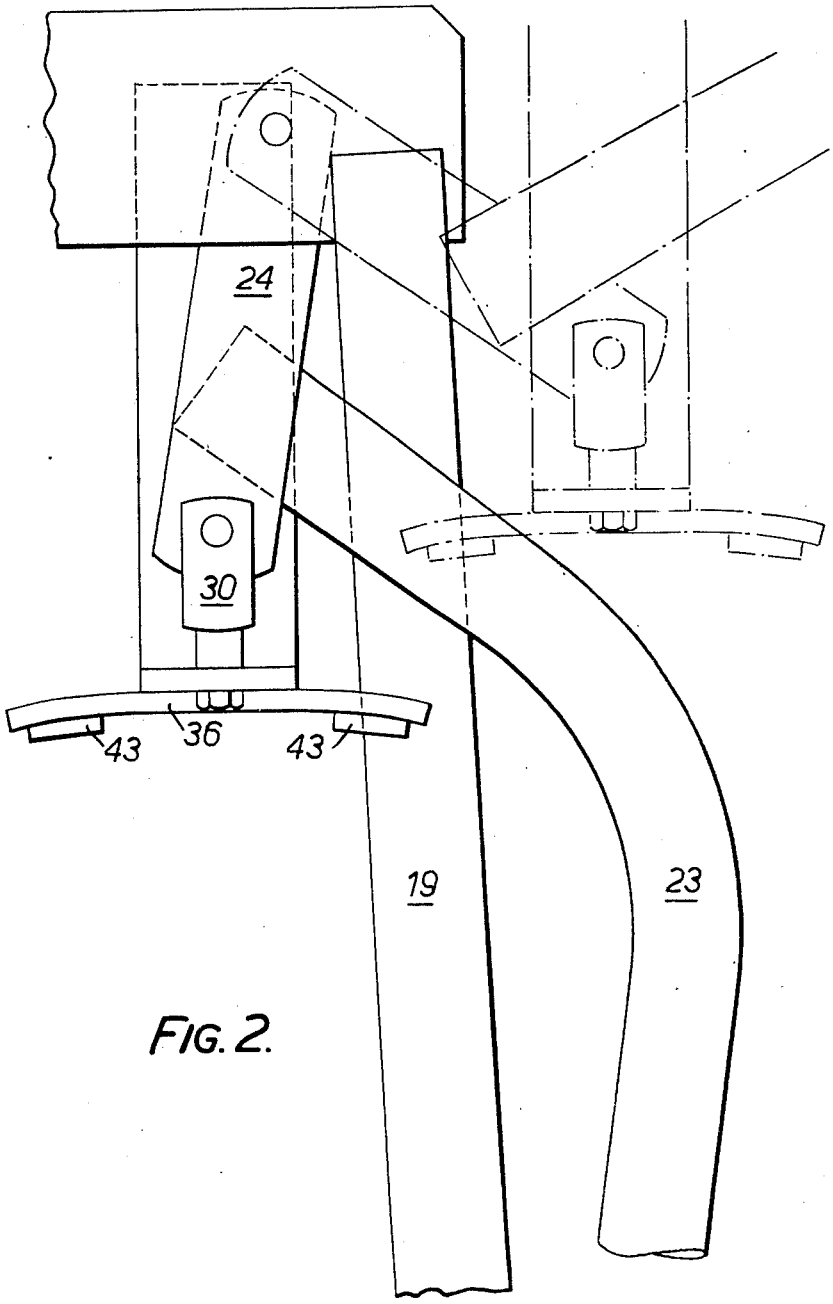

By way of example only, certain illustrative embodiments of the invention will now be described with reference to the accompanying drawings, in which:

FIG. 1 shows a perspective "exploded" view of a fire extinguisher mounting embodying the invention, FIG. 2 is a diagrammatic illustration of the operation of the mounting, and FIG. 3 is a schematic illustration of an alternative embodiment.

The mounting shown in the drawings is intended for mounting a fire extinguisher of the type having a cylindrical body about 2 feet long with an actuating mechanism and outlet hose at the top of the body. Whilst the mounting can, of course, be placed in any desired location it has features which make it particularly useful for use on a road vehicle, train, aircraft, boat or other moving body which is subject to shocks or vibration in movement.

The mounting is generally constructed of ¼ inch steel members secured together by welding. Referring to FIG. 1, the mounting has a vertical spine 1 comprising first and second angle members, 2 and 3, and a cross-bar 4. Each angle member has two fixing holes 5 (the view of the holes in member 3 is obscured) by means of which the mounting can be screwed or bolted in a desired location. The angle member 2 has a small plate 6 welded to it to define a channel 7 in which the end of the outlet hose of the extinguisher can be positioned.

At the lower end of the angle members 2 and 3, is welded a horizontal base-plate 8 comprising a square trough 9 made up of four angle pieces 10, 11, 12, 13 welded together. A ring 14 is provided within the trough and welded to it so that the base-plate provides a seating for the base of the extinguisher which it is to mount.

At the upper end of the angle members 2 and 3 is welded a member 15 bent at right angles at two points so as to provide a cross-bar 16 and extension arms 17 and 18 projecting horizontally. A strengthening bar 19 is welded at one of its ends to the end of extension arm 17 and at its other end to the base-plate 8. A similar strengthening bar 20 is provided between arm 18 and the base-plate 8.

Each of the arms 17 and 18 has a respective hole 21 drilled transversely through it to receive a respective threaded bolt 22. The holes 21 are drilled at a position towards the end of the arms 17 and 18 beyond the central plane of the extinguisher when seated in the base-plate (the reason for this is to provide an "over-centre" operation).

A U-shaped operating arm 23 is provided of ¾ inch diameter hollow tubing with the ends of the U bent back as shown, flattened at the tips and welded to respective toggle links 24 and 25. Each toggle link has a hole 26 at one end to receive a respective threaded bolt 22 and a hole 27 at the other end to receive a respective pivot pin 28. Each toggle link is formed so as to have parallel ends but with a step between the ends so that the planes of the ends are spaced apart. The shape of the toggle links and the position of attachment of the operating arm ends can be clearly seen in FIG. 1.

By means of the holes 26 and bolts 22 the operating arm 23 is pivotally mounted between the arms 17 and 18, lock-nuts 29 being provided to retain the bolts in position.

Each of the holes 27 is used in conjunction with the associated pivot pin 28 for mounting a respective pivot link 30.

Each pivot link 30 is generally U-shaped with a round shank 31 at the base of the U. Each end of the U is provided with a respective hole 32 to receive the pivot pin 28. Thus, each pivot link can be suspended from its associated toggle link by lining up the holes 27 and 32 (the end of the toggle link being in the fork of the U) and inserting the associated pin 28. Each pin 28 is provided with a respective spring clip 33 at one end, which clips on the shank 31 of the associated toggle link and so retains the pivot pin in position.

Each pivot link 30 has its shank 31 internally threaded to receive a respective bolt 34.

The mounting is completed by a pressure plate assembly 35 which comprises first and second pressure plates 36 and 37 welded to a support member 38. The support member is of integral construction and comprises lugs 39 and 40, each having a respective hole 41 drilled therein to receive an associated one of the bolts 34, and a bridging member 42 of inverted U shape. Each pressure plate has a pair of round rubber pads 43 each mounted on the underside of the associated pressure plate by means of a respective rivet 44. The pressure plate assembly is bolted to the toggle links by means of the bolts 34 inserted through the holes 41.

The pressure plates 36 and 37 are of an arcuate form (as may best be seen in FIG. 2) and are welded to the supporting member 38 at a small angle to the plane of the lugs 39 and 40. By this means, it is arranged that the four rubber pads 43 exert a substantially normal force on the rounded shoulder of the body an extinguisher placed in the mounting.

The skilled reader will, no doubt, be able to surmise the operation of the mounting from the detailed description of its construction but an account will now be given with reference to the diagrammatic illustration, FIG. 2.

Referring to the part of FIG. 2 shown in chain dotted outline, it may be seen that the operating arm has been raised. With the arm in this position, an extinguisher can be placed, base first, in the mounting. The operating arm is then lowered to bring the rubber pads into contact with the top shoulder of the extinguisher, the actuating mechanism and pressure gauge (if fitted) of the extinguisher lying within the inverted U-shape of the bridging member 42. As the operating arm is lowered still further the rubber pads are pressed more firmly against the top of the extinguisher and the pressure reaches a maximum when the toggle links are vertical. Still further lowering of the operating arm moves the mechanism over-centre to the position shown in bold outline in FIG. 2, at which point, further movement of the operating arm in the same direction is prevented by the end of the arm meeting the body of the extinguisher. The rubber pads have sufficient resiliency to allow the mechanism to move over-centre and still maintain a firm pressure on the extinguisher in the position shown in bold outline.

It will be clear that because the mechanism has moved over-centre and the base of the operating arm is engaging the body of the extinguisher, any upward movement of the extinguisher is resisted by the mechanism. It should also be noted that the length of the operating arm provides the operator with considerable leverage for forcing the mechanism over-centre whereas this leverage does not apply in the case of movement of the top of the extinguisher body. The result is that any tendency of the extinguisher to tip forward in transit is also resisted by the mechanism. It is, of course, necessary for proper operation of the mounting for an extinguisher of intended size to be used. It is envisaged that several sizes of mounting could be made, each designed for a respective size of commercially available extinguisher.

To remove the extinguisher, the operator simply pulls the operating arm outwards and upwards and the outward movement of the pressure plate assembly tips the extinguisher forwards. The operator can operate the arm with one hand and catch hold of the extinguisher with his free hand and so obtain the extinguisher very rapidly in the case of an emergency.

The described mounting enables a fire extinguisher to be securely carried on a moving vehicle in spite of shocks or vibration to which it may be subjected, yet at the same time enables the extinguisher to be rapidly removed in an emergency.

Whilst a specific embodiment has been described by way of example it should be understood that other forms and modifications are possible.

For example, compression springs could be provided to bias the pressure plate assembly against the top of an extinguisher and/or an adjustment could be provided for changing the lengths of the toggle or pivot links to suit slightly different sizes of extinguisher. The baseplate of the mounting can be modified according to the shape of the base of the extinguisher with which the mounting is to be used. Instead of the U-shaped arm having two descending limbs and a cross-piece at the bottom, a cross-piece could be provided near the top and only one descending limb employed.

The pressure plate assembly can be modified according to the type of extinguisher it is desired to mount. For example, a pressure plate in the form of a round flate plate with a central hole can be used in a mounting for the type of extinguisher having a ring at the top of the body surrounding an operating knob.

FIG. 3 illustrates schematically a specific alternative embodiment.

In FIG. 3, pressure is applied to the bottom of the extinguisher by a pressure plate 54. A hoop 55 encircles the back of the extinguisher and operating handles 56 are flared away from the body of the extinguisher to facilitate operation.

The mountings can be used for other objects besides fire extinguishers, for example the hose nozzles and connectors used in fire fighting equipment can be mounted.

The scope of the invention is defined by the appended claims.

What is claimed is:

1. A mounting for a fire extinguisher, the mounting comprising:

a spine member adapted for fixing in an upright position on a support, first force applying means mounted at one end of said spine member and projecting transversely therefrom, second force applying means mounted at the other end of said spine member and projecting transversely therefrom to co-operate with said first force applying means, said second force applying means including an over-centre linkage pivotally connected to said other end of said spine member, said over-centre linkage comprising toggle link means pivotally mounted at one end to the top of said spine member and pivotally mounted at the other end to one end of pivot link means, the other end of said pivot link means being connected to pressure plate means adapted to apply pressure to the top of the extinguisher, said pressure plate means comprising first and second spaced pressure pad means arranged to act on opposite sides of the top of the extinguisher; said first link means comprising first and second pivot link members, said first pivot link member being rigidly attached at one end to said first pressure pad means and said second pivot link member being rigidly attached at one end to said second pressure pad means; and said toggle link means comprising first and second toggle link levers, said first toggle link lever being pivotally connected at one end to one side of the top of said spine member and pivotally connected at the other end to the other end of said first pivot link lever, and said second toggle link lever being pivotally connected at one end to the other side of the top of said spine member and pivotally connected at the other end to the other end of said second pivot link lever, and manual operating means connected to said second force applying means and arranged to more said second force applying means from a position away from said first force applying means to a position towards said first force applying means in which position said overcentre linkage is in its over-centre position and said first and second force applying means apply retaining forces to the top and bottom of the extinguisher.

2. A mounting as claimed in claim 1, wherein said manual operating means is a generally U-shaped handle, the end of one limb of the U being connected to the first toggle link lever, the end of the other limb of the U being connected to the second toggle link lever, and the bend of the U being arranged to contact the body of the extinguisher to act as a stop for movement of the over-centre linkage.

3. A mounting for a fire extinguisher comprising:

a vertical spine consisting of two spaced upright angle members rigidly secured to each other by cross members at the top, bottom and an intermediate location, a base plate rigidly attached to the bottom of said angle members and projecting horizontally therefrom, first and second extension arms rigidly attached to the top of respective ones of said angle members and projecting horizontally therefrom, first and second strengthening bars, each bar being rigidly attached at one end to the distal end of a respective extension arm and at the other end to the distal end of said base plate, fixing means provided in the angle members to enable the mounting to be secured to a support, pressure plate means adapted to bear against the top of said extinguisher, first and second toggle levers pivotally mounted at one end to the distal ends of respective extension arms, means providing a pivotal connection between the other ends of said toggle levers and said pressure plate means, and an operating handle connected to move said pressure plate means from a first position in which said pressure plate is away from said base plate to a second position in which said pressure plate is towards said base plate and the extinguisher is gripped at its top and bottom, said toggle levers being in an over-centre position when said pressure plate is in its second position.

4. A mounting for a fire extinguisher, the mounting comprising:

support means including a spine member for fixing in an upright position on a support and abutment means rigidly attached to said spine at one end thereof and projecting transversely therefrom;

toggle linkage means comprising first and second links pivotally connected together at their adjacent ends, the other end of said first link being pivotally connected to said support means;

force applying means carried by the other end of said second link to lie transversely of said spine at a position spaced from said abutment means; and an operating handle projecting from one of said links and movable manually to move said toggle linkage over its dead-centre position and thereby move said force applying means from a first position away from said abutment means to a second position nearer said abutment means to grip the extinguisher at its top and bottom between said abutment means and said force applying means.

5. A mounting as claimed in claim 4, wherein said force applying means is pivotally connected to the other end of said second link.

6. A mounting as claimed in claim 5, wherein said force applying means is a pressure-plate adapted to receive the base of a fire extinguisher and connected to one end of a third link, the other end of said third link being connected to said support means.

7. A mounting as claimed in claim 4, wherein said operating handle projects out of said first link.

8. A mounting for a fire extinguisher, the mounting comprising:

a spine member adapted for fixing in an upright position on a support, said spine member having a generally oblong shape, abutment means fixedly mounted at one end of said spine member and projecting transversely therefrom, first lever means pivotally connected at one end to the distal end of said abutment means, second lever means pivotally connected at one end to the other end of said first lever means, pressure applying means adapted to contact one end of said extinguisher and mounted on the other end of said second lever means, said first and second lever means defining a toggle linkage movable through a dead-centre position between a first position in which said pressure applying means is away from said abutment means and a second position in which said pressure applying means is nearer said abutment means, one of said positions defining an unlocked position and the other of said positions defining a locked position in which said pressure applying means forces the other end of the extinguisher against an abutment.

an operating handle connecting to said toggle linkage to move said toggle linkage between said first and second positions, and stop means to limit the movement of said toggle linkage beyond said locked position.

9. A mounting as claimed in claim 8, wherein said handle is rigidly attached to said first lever means and said stop means comprises a part of said operating handle adapted to contact the side of said extinguisher.

10. A mounting as claimed in claim 9, wherein said pressure applying means is connected only to said second lever means so as to be freely carried in space thereby, abutment means are fixedly mounted at the other end of said spine member and project transversely therefrom, and said second position is said locked position in which said other end of the extinguisher is forced against the last-mentioned abutment means.

* * * * *